US006981837B2

(12) United States Patent
Gesser

(10) Patent No.: US 6,981,837 B2
(45) Date of Patent: Jan. 3, 2006

(54) INDUSTRIAL TRUCK WITH A TILTABLE LIFTING FRAME

(75) Inventor: Markus Gesser, Hanau (DE)

(73) Assignee: Linde Aktiengesellschaft, (DE)

( * ) Notice: Subject to any disclaimer, the term of this patent is extended or adjusted under 35 U.S.C. 154(b) by 431 days.

(21) Appl. No.: 10/435,603

(22) Filed: May 9, 2003

(65) Prior Publication Data

US 2004/0021308 A1 Feb. 5, 2004

(30) Foreign Application Priority Data

May 11, 2002 (DE) ..... 102 21 002

(51) Int. Cl.
*B66F 9/10* (2006.01)

(52) U.S. Cl. ..... 414/635; 187/222

(58) Field of Classification Search ..... 414/630–637, 414/914; 187/222; 384/907, 909
See application file for complete search history.

(56) References Cited

U.S. PATENT DOCUMENTS 3,321,044 A * 5/1967 Linsay ..... 414/635
4,067,393 A * 1/1978 Szarkowski ..... 172/1
5,152,658 A * 10/1992 Martin ..... 414/635
5,224,815 A * 7/1993 Abels et al. ..... 414/635
5,816,768 A * 10/1998 Yoo ..... 414/631
6,435,309 B1 * 8/2002 Hultqvist ..... 187/244
6,644,910 B2 * 11/2003 Gotz ..... 414/635

FOREIGN PATENT DOCUMENTS

DE 100 29 881 A1 12/2001

* cited by examiner

*Primary Examiner*—Thomas J. Brahan
(74) *Attorney, Agent, or Firm*—The Webb Law Firm

(57) ABSTRACT

An industrial truck has a tiltable lifting frame (2) connected with an axle body (1) mounted so that it can pivot or rotate on a vehicle chassis. To reduce noises, first and second means (4, 5) are provided for connecting the lifting frame (2) with the axle body (1). The first means (4) can have a degree of freedom in rotation around an axis of rotation (D) that is parallel to the axial center line (A) of the axle body (1). The second means (5) are at a spaced distance from the axis of rotation (D) of the first means (4) and in a plane that is perpendicular to the axis of rotation (D) and can have a degree of freedom in translation with a defined elasticity along an axis (T) that is perpendicular to the vertical dimension of the lifting frame (2). The first means (4) can be located above or below the axle body (1) and the second means (5) can be located above or below the axial center line (A) of the axle body (1).

14 Claims, 2 Drawing Sheets

INDUSTRIAL TRUCK WITH A TILTABLE LIFTING FRAME

CROSS-REFERENCE TO RELATED APPLICATION

This application corresponds to German Application No. 102 21 002.0, filed May 11, 2002, which is herein incorporated by reference in its entirety.

BACKGROUND OF THE INVENTION

1. Field of the Invention

This invention relates to an industrial truck having a tiltable lifting frame connected with an axle body that is mounted on a vehicle chassis so that the axle body can rotate and/or pivot.

2. Technical Considerations

A known industrial truck is described in DE 100 29 881 A1, herein incorporated by reference. In this known truck, the connection of the lifting frame with the axle body of the front axle has the advantage that the inertial forces that result from the load being carried are not introduced first into the vehicle chassis, but rather directly into the axle body, and from there are transmitted to the ground or roadway. As a result of the coupling of the axle body to the vehicle chassis by means of elastomers, not only is a vibration damping achieved, but advantageously a rotational capability (FIGS. 1 and 2 in DE 100 29 881 A1) of the axle body around the center line of the axis or a pivoting capability (FIG. 3 in DE 100 29 881 A1) of the axle body around a pivoting axis in the vicinity of the vehicle chassis is achieved. As a result of which, when the lifting frame is rigidly fastened to the axle body, the function of a tilt bearing is achieved. Therefore, no separate tilt bearing is necessary.

In one embodiment of this known truck, the front axle is a drive axle. Inside the axle body there are drive elements, in particular, motors, which act to generate and/or transmit vibrations. As a result of the rigid fastening of the lifting frame to the axle body (FIG. 4 in DE 100 29 881 A1), structure-borne vibrations of the axle body are transmitted to the lifting frame. Under unfavorable conditions, these vibrations can lead to resonances that are experienced in the form of noise.

Therefore, it is an object of the invention to provide an industrial truck of the general type described above but in which the noise level is reduced.

SUMMARY OF THE INVENTION

In one embodiment, first and second means to connect the lifting frame to the axle body are provided. The first means can have a rotational degree of freedom around an axis of rotation parallel to the axial center line of the axle body. The second means can be located at a spaced distance from the axis of rotation of the first means and, in a plane perpendicular to the axis of rotation, can have a degree of freedom in translation with defined elasticity along an axis which is perpendicular to the vertical extension of the lifting frame.

The invention reduces the transmission of structure-borne noise from the axle body to the lifting frame. It is thereby possible to achieve an isolation of the vibrations in an acoustically relevant frequency range.

The bending stresses are also reduced compared to a rigid restraint by the coupling of the lifting frame taught by the invention to the axle body. This increases the operating strength of the connection between the lifting frame and the axle body.

When the lifting frame is tilted, the angle of rotation of the axle body with respect to the vehicle chassis is reduced by the amount permitted by the restricted elasticity between the lifting frame and the axle body. Likewise, there are favorable effects on the useful life of the axle bearing in the vehicle chassis.

In one advantageous configuration of the invention, the first means are located above the axle body and the second means are located below the axial center line of the axle body. In a second advantageous embodiment, it is also possible to locate the above-mentioned components in the opposite order, i.e., the first means below the axial center line of the axle body and the second means above the axle body.

The first means can be advantageously located on a bracket that is connected with the lifting frame.

If the first means include an elastic bearing, the surfaces on the axle body do not require machining, which is advantageous in terms of manufacturing technology.

A development of the invention provides that there is at least one tilting cylinder on the upper end of the lifting frame. This tilting cylinder makes possible, with the application of a small amount of force, a tilting movement of the lifting frame and thereby a rotational or pivoting movement of the axle body relative to the vehicle chassis. Furthermore, the support moment, which is directed opposite to the drive moment of the motor/motors in the axle body and acts on the elastic mounting of the axle body in the vehicle chassis, can be supported by the lifting frame on the tilting cylinder, which is connected in a suitable manner with the vehicle chassis (e.g., via the roof covering the driver's cab).

BRIEF DESCRIPTION OF THE DRAWINGS

Additional advantages and details of the invention are described in greater detail below with reference to the exemplary embodiments that are illustrated in the accompanying schematic drawings.

DESCRIPTION OF THE PREFERRED EMBODIMENT

Figure 1:
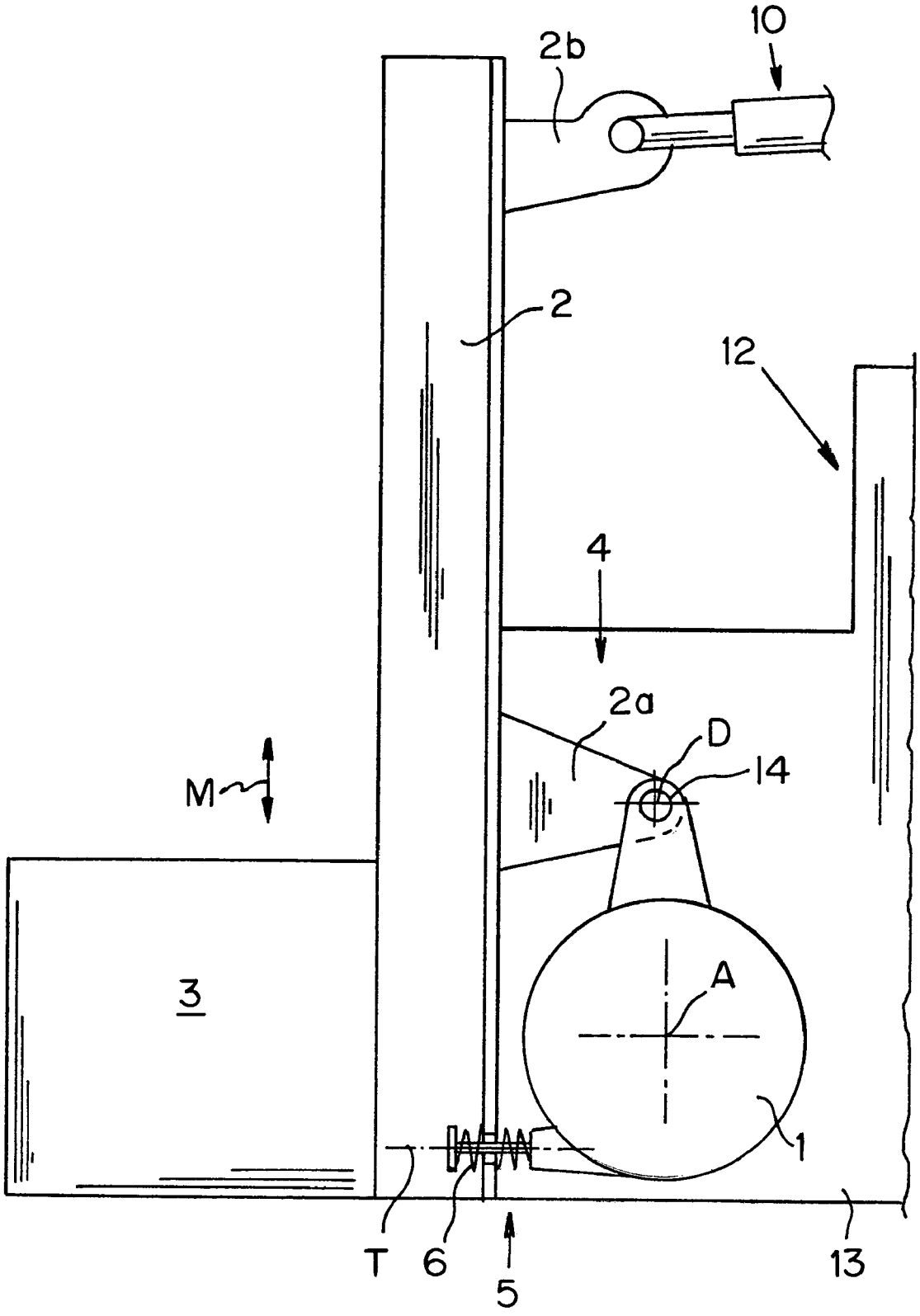
FIG. 1 illustrates a schematic side view of the front portion of a counterweighted fork-lift truck (with portions removed for clarity of the description) incorporating features of the invention.

As used herein, directional terms, such as "above", "below", "parallel", "perpendicular", "vertical", "horizontal", and the like, relate to the invention as shown in the drawing figures. However, it is to be understood that the invention can assume various other orientations.

In the portion of the fork-lift truck 12 illustrated in FIG. 1, an axle body 1 is mounted on a vehicle chassis 13 so that it can rotate around an axial center line A of the axle. The axle body 1 is connected with a lifting frame 2 on which a load 3 can be raised and lowered in conventional manner.

First means 4 and second means 5 are provided to attach the lifting frame 2 to the axle body 1. The first means 4 can be located on one side of the axle body 1, e.g., above the axle body 1 as shown in FIG. 1, and can have a degree of freedom in rotation around an axis of rotation D that is parallel to the axial center line A of the axle body 1. In one embodiment, these first means 4 can include a bearing 14 which is fastened to a bracket 2*a* of the lifting frame 2. The bearing 14 can be made of or can include an elastic material, as a result of which the requirements in terms of the manufacturing precision of the bearing 14 required can be minimized.

The second means 5 are located at a spaced distance, e.g., a vertical distance, from the first means 4. For example, the second means 5 can be located below the axial center line A of the axle body 1 as shown in FIG. 1. By "vertical" is meant parallel to the direction of movement M of the lifting frame 2. The second means 5 can be configured so that in a plane that is perpendicular to the axis of rotation D there is a degree of freedom in translation with defined elasticity along an axis T which is perpendicular to the vertical dimension of the lifting frame 2. Of course it is also possible, in the illustrated exemplary embodiment, to locate the elasticity affected by springs 6 in another axis, in which case a deflection to the axis T of translation can be achieved, e.g., by a toggle lever or similar device.

The second means 5 are theoretically a restraint of the movement in translation, i.e., an arrangement that permits translation movements only within narrow limits. As a result of the restraint on the movement in translation with defined elasticity, the lifting frame 2 can execute restricted rotational movements around the axis of rotation D.

Figure 2:
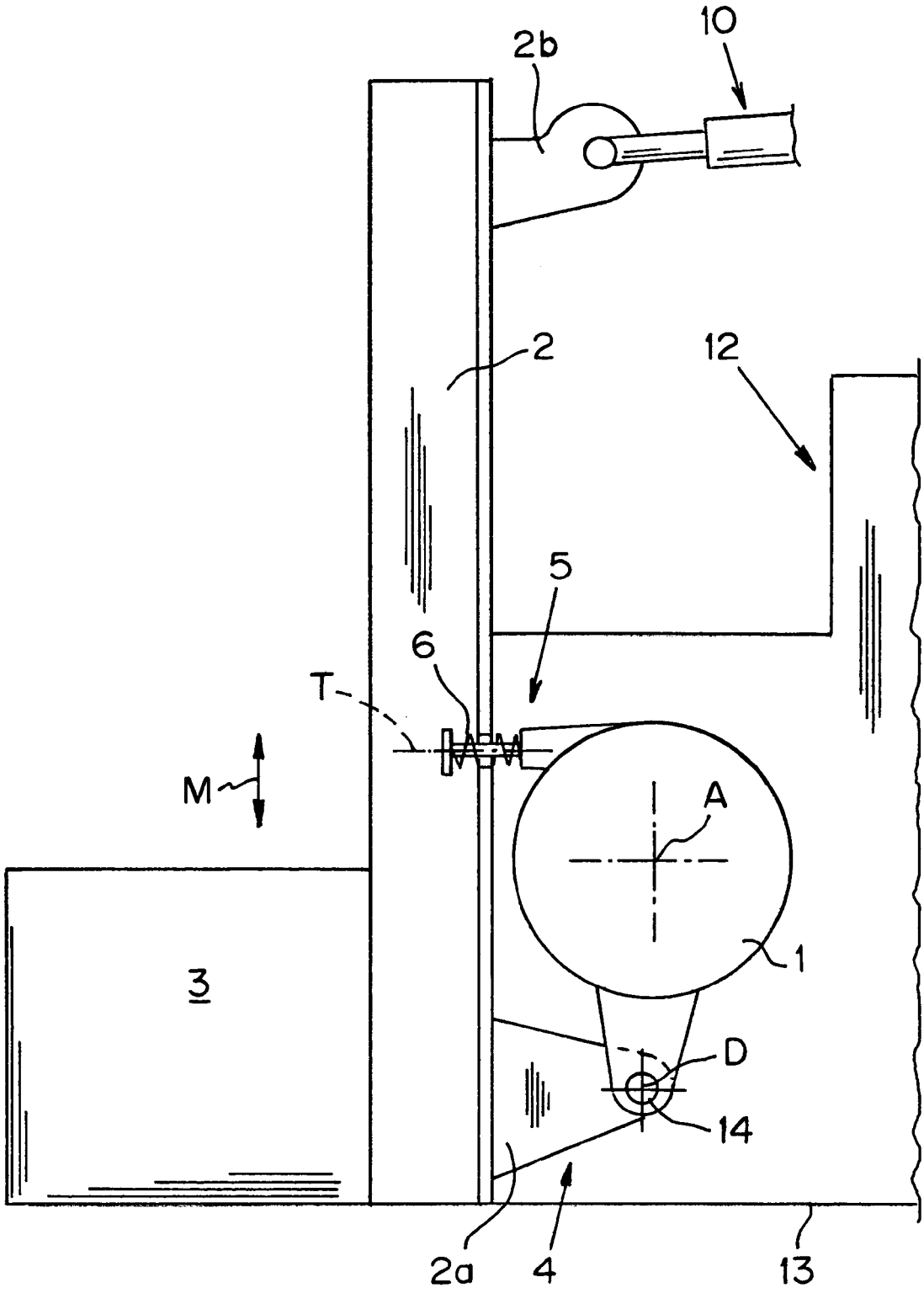
FIG. 2 illustrates a schematic side view of the front portion of another counterweighted fork-lift truck (with portions removed for clarity of the description) incorporating features of the invention.

FIG. 2 illustrates an alternative embodiment in which the first means 4 are located below the axial center line A of the axle body 1 and the second means 5 are located above the axle body 1.

The connection of the lifting frame 2 with the axle body 1 in the invention reduces the transmission of structure-borne noise from the axle body 1 to the lifting frame 2 and, thus, the generation of resonance vibrations of the lifting frame 2 which are perceivable as externally emitted noise and are frequently found to be disruptive.

A tilting cylinder 10 can be fastened to the upper end of the lifting frame 2, e.g., to a bracket 2*b*.

The angular mobility required during a tilting of the lifting frame 2 is divided into a twisting movement of the axle body 1 with respect to the vehicle chassis around the axial center line A and a comparatively smaller twisting movement of the lifting frame with respect to the axle body 1 around the axis of rotation D.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An industrial truck, comprising:

a vehicle chassis;

an axle body connected to the vehicle chassis, such that the axle body can pivot and/or rotate with respect to the vehicle chassis; and a tiltable lifting frame connected with the axle body by first and second connecting means, wherein the first means have a degree of freedom in rotation around an axis of rotation that is parallel to an axial center line of the axle body, and wherein the second means are at a spaced distance from the axis of rotation of the first means and in a plane that is perpendicular to the axis of rotation of the first means and have a degree of freedom in translation with defined elasticity along an axis that is perpendicular to a vertical dimension of the lifting frame.

2. The industrial truck as claimed in claim 1, wherein the first means are located above the axle body and the second means are located below the axial center line of the axle body.

3. The industrial truck as claimed in claim 2, wherein the first means are connected to a bracket that is connected with the lifting frame.

4. The industrial truck as claimed in claim 2, wherein the first means include an elastic bearing.

5. The industrial truck as claimed in claim 2, including at least one tilting cylinder located at an upper end of the lifting frame.

6. The industrial truck as claimed in claim 1, wherein the first means are located below the axial center line of the axle body and the second means are located above the axle body.

7. The industrial truck as claimed in claim 6, wherein the first means are connected to a bracket that is connected with the lifting frame.

8. The industrial truck as claimed in claim 6, wherein the first means include an elastic bearing.

9. The industrial truck as claimed in claim 6, including at least one tilting cylinder located at an upper end of the lifting frame.

10. The industrial truck as claimed in claim 1, wherein the first means are connected to a bracket that is connected with the lifting frame.

11. The industrial truck as claimed in claim 1, wherein the first means include an elastic bearing.

12. The industrial truck as claimed in claim 11, including at least one tilting cylinder located at an upper end of the lifting frame.

13. The industrial truck as claimed in claim 1, including at least one tilting cylinder located at an upper end of the lifting frame.

14. The industrial truck as claimed in claim 1, wherein the first means are positioned on one side of the axle center line and the second means are positioned on an opposite side of the axle center line.

* * * * *